United States Patent [19]

Scott

[11] 4,079,642

[45] Mar. 21, 1978

[54] STRAP WRENCH

[76] Inventor: Michael J. Scott, 205-1100 Munroe Ave., Winnipeg, Canada

[21] Appl. No.: 786,606

[22] Filed: Apr. 11, 1977

[51] Int. Cl.[2] ..... B25B 13/52

[52] U.S. Cl. ..... 81/64

[58] Field of Search ..... 81/64, 3.43; 294/74, 294/31.2

[56] References Cited

U.S. PATENT DOCUMENTS

| | | | |
|---|---|---|---|
| 651,220 | 6/1900 | Warnock | 81/64 |
| 2,057,949 | 10/1936 | Hodson | 81/64 |
| 3,211,489 | 10/1965 | Gill | 294/74 |
| 3,352,590 | 11/1967 | Barthule | 294/74 |
| 4,010,662 | 3/1977 | Perrault | 81/64 |

*Primary Examiner*—James L. Jones, Jr.
*Attorney, Agent, or Firm*—Stanley G. Ade

[57] ABSTRACT

A sliding or wrenching strap portion is secured by one end thereof to one side of a buckle frame and is formed into a bight. The other end passes through the buckle frame and terminates in a handle. A tension or locking strap is secured by one end to the other side of the buckle and also terminates in a handle. In use, the bight is engaged around the object or component to be turned and the brace handle steadies the buckle and acts as a reaction or tension member. Tangential pull on the first handle with tension applied by the second handle, causes torque to be applied to the object to be turned.

4 Claims, 4 Drawing Figures

STRAP WRENCH

BACKGROUND OF THE INVENTION

This invention relates to new and useful improvements in strap wrenches.

Strap wrenches are used to wrap around a component such as a pipe or other component that requires rotation. They are often used for replacing oil filters in automobiles, but the device is not limited to such use.

Conventional devices require a force to be applied substantially concentric with the circumference of the component or portion being turned.

Many strap wrenches require close working to actuate their wrenching capabilities and often there is not enough room for one to operate these wrenches in close quarters such as for example, a car engine.

They all require a circular wrenching motion to actuate a similar wrenching motion and most involve the manufacture of specialized components such as pins, cams and the like.

The majority of strap wrenches work along a principle wherein the strap wrenches first lock tightly against the component, which is usually a cylindrical component, by mechanical means and then the turning of the component is operated by turning or pulling some part of the mechanical component or the strap in a circular fashion.

SUMMARY OF THE INVENTION

The present invention overcomes these disadvantages by utilizing a concept wherein the strap part of the wrench locks around itself in a type of a cinching motion with the strap passing freely through a buckle frame so that the straight line or tangential pull actuates the turning of the strap wrench.

One aspect of the invention is to provide a strap wrench for rotating a component or the like comprising in combination a wrenching strap, a buckle frame and a locking strap, said wrenching strap being secured by one end thereof to one side of said buckle frame, said locking strap being secured by one end thereof to the other side of said buckle frame, a bight formed in said wrenching strap with the standing part of said wrench strap passing freely through said buckle frame between the sides thereof, and hand engaging portions of the other ends of each of said straps.

Another object of the invention is to provide a device of the character herewithin described which is extremely simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 1:
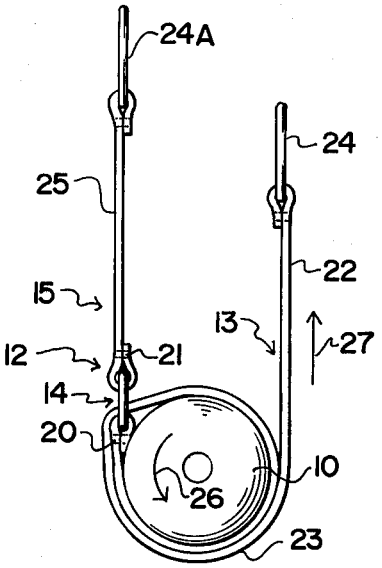
FIG. 1 is an end view of the wrench shown in position upon a component to be rotated anti-clockwise.
Figure 2:
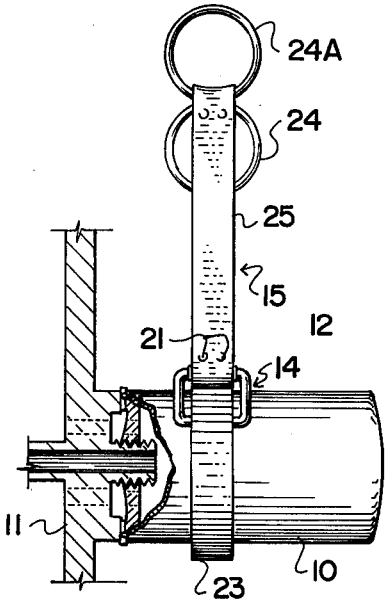
FIG. 2 is a view from the left hand side of FIG. 1.
Figure 3:
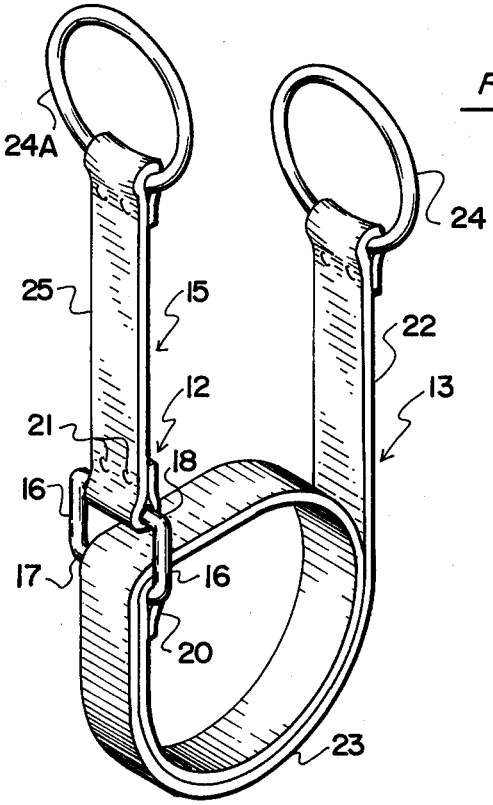
FIG. 3 is an isometric view of the strap wrench per se.

Proceeding therefore to describe the invention in detail, reference character 10 illustrates a component such as an oil filter screw-threadably engageable within a wall 11 of an automobile engine or the like. However, it will be appreciated that the strap wrench can be used to rotate any component which requires such rotation such as pipes or the like.

The strap wrench collectively designated 12, comprises a wrenching strap 13, a buckle frame 14, and a locking strap 15.

The straps 13 and 15 are preferably manufactured from a flexible non-stretching material such as woven nylon, leather or the like.

Figure 4:
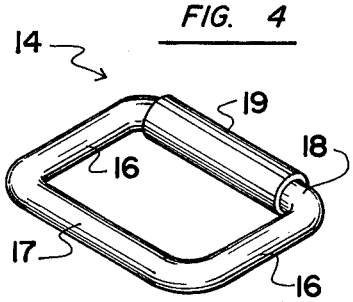
FIG. 4 is an isometric view of the buckle frame per se.

The buckle frame 14 is preferably manufactured from metal and includes end portions 16, one side portion 17 and a further opposite side portion 18 thus making a substantially rectangular open buckle frame as illustrated in FIG. 4.

Preferably but not necessarily, a cylindrical sleeve 19 is freely engaged around the side portion 18 and rotates freely thereon.

The wrenching strap 13 is secured by one end 20 thereof around one side 17 of the frame 14 as by rivets or stitching or the like indicated by reference character 21.

The other end or standing part 22 is looped around to form a bight 23 and then passes downwardly through the frame 14 between the sides 17 and 18 and then follows the contour of the bight 23 and extends tangentially upwardly with reference to the drawings. It then terminates in a handle engaging portion 24 at said other end 22 thereof.

The locking or tension strap 15 is also secured by one end thereof around the opposite side 18 of the frame in a manner smilar to that hereinbefore described and a similar handle portion 24A is secured to the other end 25 thereof. It also extends upwardly, with reference to the drawings, when in use.

In operation, the bight 23 is engaged around the component 10 and positioned to rotate the component in the desired direction.

If it is desired to rotate the component in the anti-clockwise direction indicated by reference character 26, then the bight is positioned as shown. However, if it is desired to rotate the component 10 in the opposite direction to arrow 26, then the bight is reversed with respect to FIG. 1.

The handle portion 24A is then pulled upwardly to tighten the bight around the component and tension is applied to the handle portion 24A to act as a reactor to the tangential pull which is then applied to the portion 24A in the direction of arrow 27.

The cinching or self-wrapping action grips the component 10 tightly and enables torque to be applied to the component with the pull applied by the standing part 22 extending tangentially from the circumference of the portion of the bight 23.

Inasmuch as both handle portions 24 and 24A can extend upwardly relatively close together, the device can be operated remotely from the component 10 as clearly shown in FIG. 1.

As mentioned previously, the reverse action is obtained by reversing the strap wrench upon the component 10.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A strap wrench for rotating a component or the like comprising in combination a wrenching strap, a buckle frame and a locking strap, said wrenching strap being secured by one end thereof to one side of said buckle frame, said locking strap being secured by one end thereof to the other side of said buckle frame, a bight formed in said wrenching strap with the standing part of said wrench strap passing freely through said buckle frame between the sides thereof, and hand engaging portions on the other ends of each of said straps.

2. The strap wrench according to claim 1 in which said one ends of said straps are rotatably engaged around the sides of said buckle frame.

3. The strap wrench according to claim 1 in which said bight engages around said component with said standing part extending tangentially from the surface of said bight engaging part of the component.

4. The strap wrench according to claim 2 in which said bight engages around said component with said standing part extending tangentially from the surface of said bight engaging around part of the component.

* * * * *